US010433606B2

(12) United States Patent
Ott

(10) Patent No.: US 10,433,606 B2
(45) Date of Patent: Oct. 8, 2019

(54) APPLICATOR FOR REPLACEMENT HAIR STRANDS

(71) Applicants: HAIRDREAMS HAARHANDELS GMBH, Graz (AT); Gerhard Ott, Singapore (SG)

(72) Inventor: Gerhard Ott, Singapore (SG)

(73) Assignee: HAIRDREAMS HAARHANDELS GMBH, Graz (AT)

( * ) Notice: Subject to any disclaimer, the term of this patent is extended or adjusted under 35 U.S.C. 154(b) by 838 days.

(21) Appl. No.: 14/896,277

(22) PCT Filed: Apr. 7, 2014

(86) PCT No.: PCT/AT2014/050080
§ 371 (c)(1),
(2) Date: Dec. 4, 2015

(87) PCT Pub. No.: WO2014/194343
PCT Pub. Date: Dec. 11, 2014

(65) Prior Publication Data

US 2016/0128409 A1 May 12, 2016

(30) Foreign Application Priority Data

Jun. 7, 2013 (AT) ..... A 50376/2013

(51) Int. Cl.
*A41G 5/00* (2006.01)

(52) U.S. Cl.
CPC ..... *A41G 5/0086* (2013.01); *A41G 5/008* (2013.01)

(58) Field of Classification Search
CPC ..... A41G 5/0086; A41G 5/008; A45D 6/12; A45D 2200/155; A45D 1/10
USPC ..... 219/231; 165/61
See application file for complete search history.

(56) References Cited

U.S. PATENT DOCUMENTS

| | | | | |
|---|---|---|---|---|
| 4,442,849 | A * | 4/1984 | Kawabe | A45D 1/04 132/232 |
| 6,627,852 | B1 * | 9/2003 | Savone | A45D 1/04 132/232 |
| 6,935,348 | B2 * | 8/2005 | Gold | A41G 5/004 132/201 |
| 2006/0207625 | A1 * | 9/2006 | Chan | A45D 1/04 132/224 |
| 2009/0188514 | A1 * | 7/2009 | Hsu | A41G 5/008 132/201 |
| 2010/0083978 | A1 * | 4/2010 | Hottenrott | A45D 1/06 132/211 |

(Continued)

*Primary Examiner* — Tatiana L Nobrega
*Assistant Examiner* — Brianne E Kalach
(74) *Attorney, Agent, or Firm* — John P. White; Cooper & Dunham LLP

(57) ABSTRACT

The invention relates to an applicator (1) for replacement hair strands, one end of the hair of which is embedded into a thermoplastic element. The applicator has a punch/die unit (5, 6), the mutually facing working profiled sections of which are adapted to the shape of at least one thermoplastic element. In order to ensure a fault-free, continuous hot-melt adhesion between a person's own hair strands and the replacement hair strands, the punch (6) is arranged on a pivoting head (10) which supports an additional punch (11) with substantially the same contours, wherein the punch (6) is provided with a heating device (12), and the additional punch (11) is provided with a cooling device (13).

20 Claims, 8 Drawing Sheets

(56) References Cited

U.S. PATENT DOCUMENTS

2011/0056509 A1* 3/2011 Benest ..... A45D 1/04
132/223

* cited by examiner

APPLICATOR FOR REPLACEMENT HAIR STRANDS

The present application is a § 371 national stage of PCT International Application No. PCT/AT2014/050080, filed Apr. 7, 2014, claiming priority of Austrian Patent Application No. A50376/2013, filed Jun. 7, 2013, the contents of each of which are hereby incorporated by reference in their entirety.

The invention relates to an applicator for replacement hair strands, one end of the hair of which is embedded in a thermoplastic element, which applicator comprises a punch-die unit, the mutually facing action profiles of which are adapted to the shape of at least one thermoplastic element.

An applicator of the mentioned type has become known from European Patent EP 1424017 B1. According to this, a replacement hair strand is inserted with its thermoplastic element into the matrix in the course of the use of the hair strand, upon which a person's own hair strand is inserted into the gap between the die and the punch and is embedded in the thermoplastic element by hot-melt adhesion by pressing the punch and the die together under the influence of heat.

Experience has shown that when working with the known applicator, frequent pauses have to be made because the punch-die unit becomes too warm, so that the thermoplastic element sticks together when the unit is opened or forms threads or softens or melts altogether.

It is therefore the aim of the invention to remove this disadvantage, i.e. to ensure a continuous operation via an optimal temperature profile.

According to the invention, this aim is achieved by means of an applicator of the type mentioned at the beginning as a result of the fact that the punch is disposed on a pivoting head that carries an additional punch with substantially the same contours, which punch is provided with a heating unit, the additional punch is provided with a cooling unit.

On account of the pivoting head according to the invention with a warm punch and a cold additional punch, the warm punch is initially used to initiate the hot-melt adhesion during the application of a replacement hair strand, and after opening the press nip and pivoting the pivoting head, post-pressing is carried out using the cold additional punch, whereupon the resulting finished connection, conditioned by the thermoplastic element, of the replacement hair strand with a person's own hair strand can be removed from the press nip. In this way, any malfunctions of the applicator due to overheating of the punch-die unit and any resulting faulty or unsightly hair connections are avoided.

It has proven to be expedient if the pivoting head is implemented as a cooling body that is heat insulated with respect to the punch, since in practice, a temperature differential of approx. 200° C. is needed between the punch and the additional punch.

The heating unit of the punch may be implemented in any way that is well known to a person skilled in the art. However, it has proven to be most favorable if it is implemented as an electric heating mat that is embedded in the punch.

The cooling unit of the additional punch may preferably have at least one Peltier element because, as is known, the applicator is electrically operated as per usual, and as a result the Peltier effect can be utilized in an elegant manner. Alternatively or additionally, further cooling may be provided on account of the fact that a fan mounted so as to be stationary is provided on the side facing away from the punch and the additional punch.

In order to ensure the operating mode of the applicator according to the invention, namely firstly hot pressing, then cold pressing, with the most simple means, an embodiment is preferred, according to which the pivoting head is received in a bearing on a slide that can be moved to and fro relative to the die and is equipped with a drive. In this connection it is advisable to provide a crank drive on the slide, which is driven by a motor and can be pivoted between two limit positions, the connecting rod of which crank drive is hinged to the pivoting head outside of the bearing thereof.

Moreover, for a time-saving and efficient functioning mode, it is advantageous if the punch, the additional punch and the die each have an action profile for simultaneously receiving a plurality of thermoplastic elements. In this case, it becomes possible to apply at the same time, instead of in each case a single thermoplastic element together with a replacement hair strand, a hair strip composed of several such units.

The invention will be explained in more detail below by way of an embodiment example illustrated in the drawing, wherein.

Figure 1:
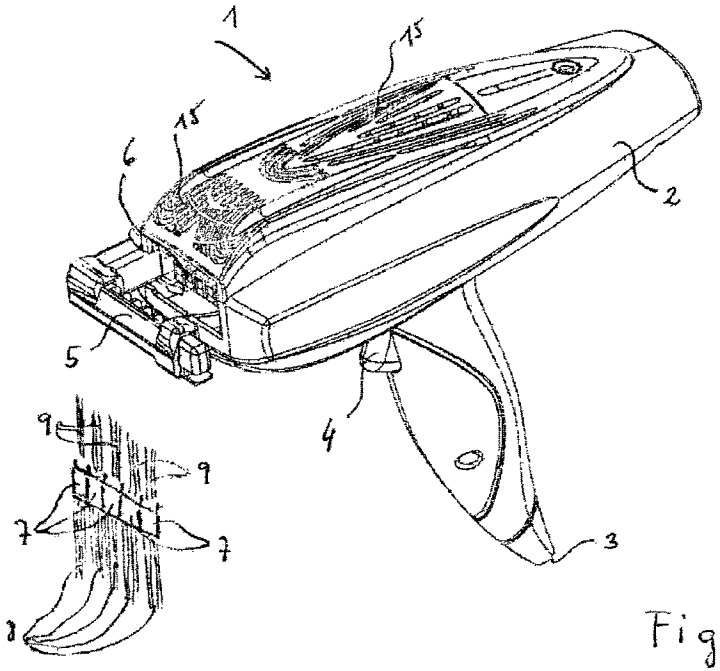
FIG. 1 shows a diagonal view of an applicator according to the invention for replacement hair strands as well as replacement hair and replacement hair strands in a schematic manner.
Figure 2:
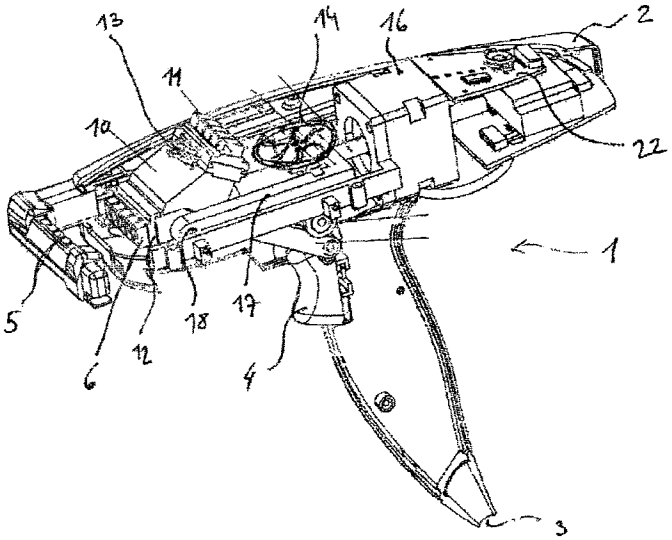
FIG. 2 shows the same diagonal view, however with a removed housing.

The applicator 1 according to the invention for replacement hair strands includes a housing 2 with a pistol handle, at the bottom end 3 of which a power cable (not shown) enters. Its motion sequence is triggered by an actuator 4. The core piece of the applicator 1 is a punch-die unit, wherein the die 5 is stationary and protrudes from the housing 2, whereas the punch 6 is movable and is in the housing 2 in its idle condition. The die 5 and the punch 6 each have an action profile that is suitable, e.g., for receiving five thermoplastic elements 7 that lie next to each other in the form of strips, with replacement hair strands 8 embedded on the end side. However, the number of thermoplastic elements 7 that can be processed at the same time may also be higher, e.g. 14. In the course of the application of the replacement hair strands 8, the latter are (as indicated in FIG. 1) inserted with their thermoplastic elements 7 into the die 5, whereupon corresponding own hair strands 9 are placed upon them and are subsequently pressed together using the punch 6.

As can be seen in FIGS. 2 to 8, the punch 6 is provided on a pivoting head 10 that carries an additional punch 11 with substantially the same contours. The punch 6 is provided with a heating unit 12 indicated in the drawing, which may for example consist of an electric heating mat embedded in the punch 6. However, the additional punch 11 is provided with a cooling unit 13, which in the preferred embodiment example consists of at least one Peltier element. The pivoting head 10 is implemented as a cooling body, for example from aluminum, which is heat-insulated in respect of the punch 6. The reason is that the operating temperature of the punch 6 is approx. 200 to 210° C., whereas that of the additional punch 11 is only 18 to 20° C. In order to support the cooling unit 13, a fan 14 (FIG. 2) that is placed to be stationary is provided in the housing 2 on that side of the pivot head 10 that faces away from the punch 6 and the additional punch 11. Accordingly, the housing 2 has venting slots 15 (FIG. 1).

The pivoting head 10 is received in a bearing 18 on a slide 17 that can be moved to and fro relative to the die 5 and is provided with a drive 16. On the slide 17, a crank drive 20 driven by a motor 19 and pivotable between two limit positions is provided, the connecting rod 21 of which crank drive is hinged to the pivot head 10 outside of the bearing 18 thereof.

In the end region of the housing 2 that faces away from the die 5, a programming unit 22 is accommodated (FIG. 2), by means of which the motion sequences (stroke length, dwell times, etc.) of the drive 16 and the motor 19 can be specified and the temperatures of the punch 6 and the additional punch 11 can be selected.

Figure 3:
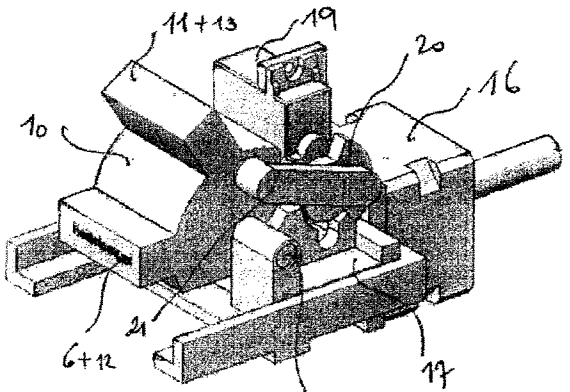
FIGS. 3 to 8 show, in a schematic view, the motion sequence of the pivoting head according to the invention.
Figure 4:
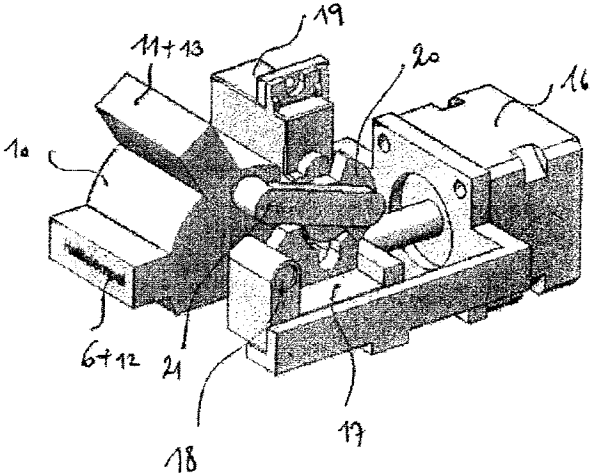
Figure 5:
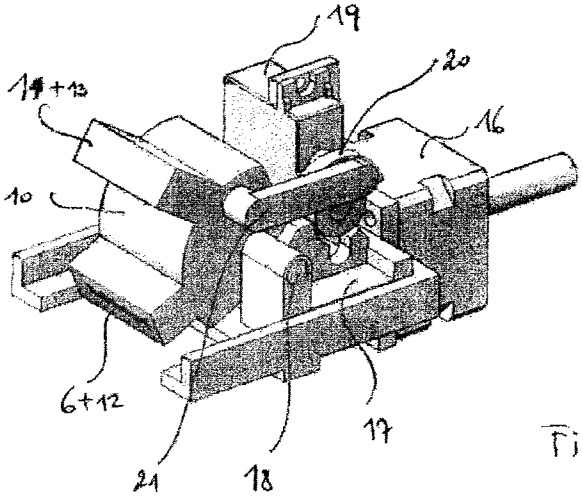
Figure 6:
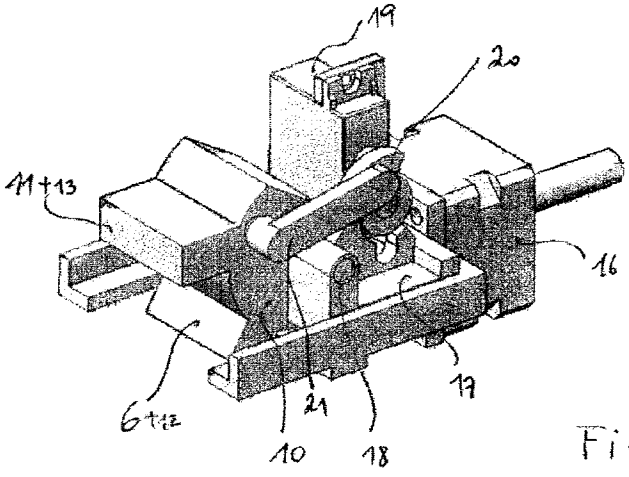
Figure 7:
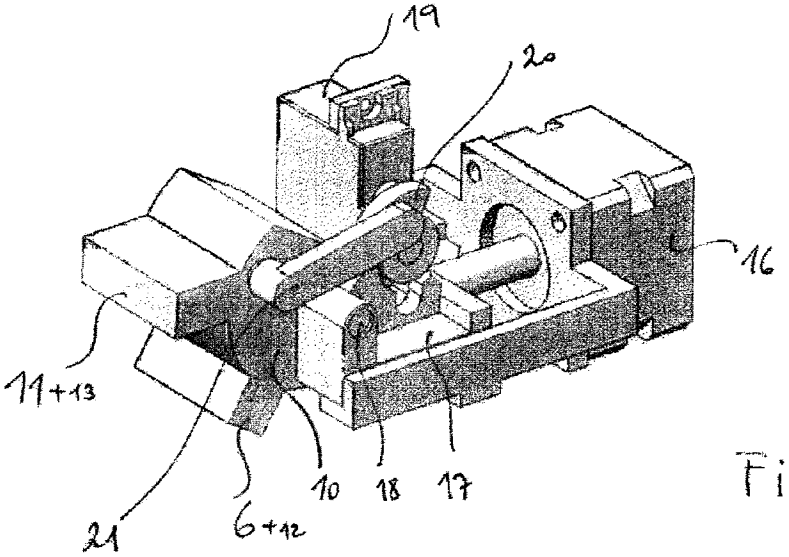
Figure 8:
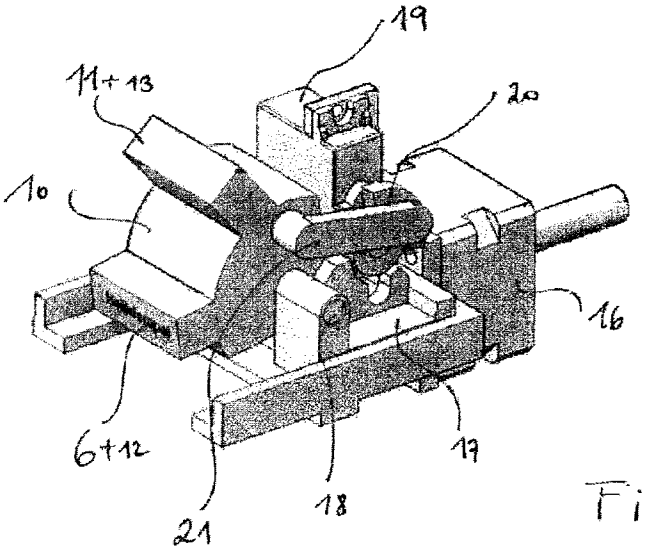

If during the use of the applicator 1 according to the invention, after inserting the thermoplastic elements 7 in the die 5 and introducing a person's own hair strands 9 into the gap located between the die and the punch 6 the operating temperatures have been reached, the entire motion sequence is triggered by the actuator 4. Proceeding from the position shown in FIG. 3, the punch 6 is advanced by means of the drive 16 in the direction of the die 5 (FIG. 4) and the hot pressing operation is carried out. Subsequently, the slide 17 is returned (FIG. 5) and the pivoting head 10 is pivoted downwards by means of the motor 19 and the crank drive 20, until it has reached the position indicated in FIG. 6, in which the additional punch 11 occupies the same position the punch 6 had at the beginning (FIG. 3). Then, the slide is again moved by the drive 16 in the direction of the die 5 (FIG. 7), as a result of which a cold pressing operation is carried out. Finally, the slide 17 is returned by means of the drive 16 and the pivoting head 10 is brought back into its initial position via the motor 19 and the crank drive 20, in which the punch 6 is located opposite the die 5 as in FIG. 3 (FIG. 8). Subsequently, the hair connections can be removed from the die 5 and the hair applicator can be used in a different place. By means of the programming unit 22, the fan 14 can be switched either to permanent operation or to temperature-dependent operation.

The invention claimed is:

1. A hair extension applicator (1) for replacement hair strands (8), one end of the hair of the replacement hair strands (8) being embedded in at least one thermoplastic element (7) for hot-melt adhesion of the replacement hair strands (8) to a user's hair, the applicator (1) comprising:

a housing (2) extending along a longitudinal direction;

a stationary die located at a spaced distance from an end of the housing and extending along a-direction perpendicular to the longitudinal direction of the housing;

a first punch and a second punch located on a pivoting head (10), the pivoting head (10) pivoting about an axis of pivot parallel to said direction perpendicular to the longitudinal direction of the housing (2) for aligning one of the first and second punches with the die at a time, wherein the first punch (6) is provided with a heating unit (12), and the second punch (11) is provided with a cooling unit (13); the first and second punches having profiles complimentary to and facing the stationary die and are disposed to provide a gap between the die and an aligned one of the first and second punches to receive said at least one thermoplastic element;

wherein the pivoting head is received in a bearing on a slide that translates to and fro along the longitudinal axis relative to the stationary die for hot and cold pressing the replacement hair strands to a user's hair.

2. The applicator according to claim 1, wherein the pivoting head (10) includes a heat sink that is heat-insulated with respect to the punch (6).

3. The applicator according to claim 2, wherein the heating unit (12) of the punch (6) includes an electric heating mat embedded into said punch.

4. The applicator according to claim 2, wherein the cooling unit (13) of said additional punch (11) has at least one Peltier element.

5. The applicator according to claim 2, wherein a stationary fan (14) is provided on a side of the pivoting head (10) that faces away from each of the punch (6) and said additional punch (11).

6. The applicator according to claim 2, wherein the pivoting head (10) is received in a bearing (18) on a slide (17) that is movable to and from in relation to the die (5) and is provided with a drive (16).

7. The applicator according to claim 2, wherein the punch (6), said additional punch (11) and the die (5) each have a profile for receiving plural thermoplastic elements (7) at the same time.

8. The applicator according to claim 1, wherein the heating unit (12) of the punch (6) includes an electric heating mat embedded into said punch.

9. The applicator according to claim 8, wherein the cooling unit (13) of said additional punch (11) has at least one Peltier element.

10. The applicator according to claim 8, wherein a stationary fan (14) is provided on a side of the pivoting head (10) that faces away from each of the punch (6) and said additional punch (11).

11. The applicator according to claim 8, wherein the pivoting head (10) is received in a bearing (18) on a slide (17) that is movable to and from in relation to the die (5) and is provided with a drive (16).

12. The applicator according to claim 8, wherein each of the punch (6) and said additional punch (11) is provided on, and protrudes from, the pivoting head (10).

13. The applicator according to claim 1, wherein the cooling unit (13) of said additional punch (11) has at least one Peltier element.

14. The applicator according to claim 13, wherein a stationary fan (14) is provided on a side of the pivoting head (10) that faces away from each of the punch (6) and said additional punch (11).

15. The applicator according to claim 13, wherein the pivoting head (10) is received in a bearing (18) on a slide (17) that is movable to and from in relation to the die (5) and is provided with a drive (16).

16. The applicator according to claim 1, wherein a stationary fan (14) is provided on a side of the pivoting head (10) that faces away from each of the punch (6) and said additional punch (11).

17. The applicator according to claim 16, wherein the pivoting head (10) is received in a bearing (18) on a slide (17) that is movable to and from in relation to the die (5) and is provided with a drive (16).

18. The applicator according to claim 1, wherein the pivoting head (10) is received in a bearing (18) on a slide (17) that is movable to and from in relation to the die (5) and is provided with a drive (16).

19. The applicator according to claim 18, wherein a crank drive (20) driven by a motor (19) and pivotable between two limit positions is provided on the slide (17), the crank drive (20) including a connecting rod (21) hinged to the pivoting head (10) at a portion of the pivoting head (10) different from a portion of the pivoting head (10) received by the bearing (18).

20. The applicator according to claim 1, wherein the punch (6), said additional punch (11) and the die (5) each have a profile for receiving plural thermoplastic elements (7) at the same time.

* * * * *